US005611278A

United States Patent [19]

Garner et al.

[11] Patent Number: 5,611,278

[45] Date of Patent: Mar. 18, 1997

[54] TEMPERATURE CONTROLLED SYSTEM FOR PRINTING PRESS

[75] Inventors: Steve M. Garner, Arlington; Max W. Hess, N. Richland Hills, both of Tex.

[73] Assignee: Sun Graphic Technologies, Inc., Fort Worth, Tex.

[21] Appl. No.: 540,902

[22] Filed: Oct. 11, 1995

Related U.S. Application Data

[63] Continuation of Ser. No. 369,293, Jan. 6, 1995, abandoned, which is a continuation of Ser. No. 14,717, Feb. 8, 1993, abandoned.

[51] Int. Cl.[6] ..... B41F 31/00

[52] U.S. Cl. ..... 101/349

[58] Field of Search ..... 101/349, 350, 101/363, 207, 208, 209, 210, 148, 364, 216; 210/175; 62/79, 197, 99; 165/2, 61, 62, 64, 65

[56] References Cited

U.S. PATENT DOCUMENTS

| | | | |
|---|---|---|---|
| 2,255,410 | 9/1941 | Case | 91/67.8 |
| 2,260,364 | 10/1941 | Case | 101/216 |
| 2,971,460 | 2/1961 | Shindle | 101/416 |
| 3,741,115 | 6/1973 | Keller | 101/148 |
| 3,772,896 | 11/1973 | Rao | 62/79 |
| 3,780,796 | 12/1973 | Miram et al. | 165/39 |
| 4,183,298 | 1/1980 | Cappel et al. | 101/348 |
| 4,718,245 | 1/1988 | Van Steenburgh | 62/197 X |
| 4,742,689 | 5/1988 | Lowes | 62/197 |
| 4,879,951 | 11/1989 | Yoshida et al. | 101/363 |
| 5,074,213 | 12/1991 | Kurosawa | 101/487 |
| 5,272,971 | 12/1993 | Fredericks | 101/350 |

FOREIGN PATENT DOCUMENTS

| | | |
|---|---|---|
| 2250877 | 7/1973 | Germany . |
| 3904854C1 | 4/1990 | Germany . |
| 4108883A1 | 9/1992 | Germany . |
| 60-257248 | 6/1984 | Japan . |
| 60-161152 | 8/1985 | Japan . |
| 62-227749 | 3/1986 | Japan . |
| 61-191152 | 8/1987 | Japan . |
| 321453A | 1/1991 | Japan . |
| 321455A | 1/1991 | Japan . |
| 414452A | 1/1992 | Japan . |

OTHER PUBLICATIONS

"Temperature Modulation of the Inking System of Rotary Offset Presses as a Process–Stabilizing Factor", Technischer Informationsdienst, 1982, pp. 1–4.

*Primary Examiner*—J. Reed Fisher
*Attorney, Agent, or Firm*—Geoffrey A. Mantooth

[57] ABSTRACT

The system of the present invention controls the temperature of ink so as to enhance print quality. An ink roller has a circulation path therein. A circulation system circulates fluid, such as water, through the ink roller and through a heat exchanger. The heat exchanger is part of a refrigeration and heating system that selectively cools and heats the circulating water. The refrigeration and heating system uses a compressor, an expansion valve and the heat exchanger. To provide refrigeration, refrigerant fluid is circulated in the refrigeration and heating system through the expansion valve and to the heat exchanger. To provide heating, the expansion valve is bypassed by a conduit, wherein hot fluid from the compressor flows directly to the heat exchanger.

7 Claims, 3 Drawing Sheets

TEMPERATURE CONTROLLED SYSTEM FOR PRINTING PRESS

This is a continuation of application Ser. No. 08/369,293 filed Jan. 06, 1995, now abandoned, which, application is a continuation of application Ser. No. 08/014,717, filed Feb. 08, 1993, now abandoned.

FIELD OF THE INVENTION

The present invention relates to printing presses, and more particularly, to systems for controlling the temperature of fluids in printing presses.

BACKGROUND OF THE INVENTION

In traditional lithographic printing presses, ink and dampening fluid are applied by rollers onto a lithographic printing plate. The printing plate is mounted onto a plate cylinder which rotates the printing plate past the ink and dampening rollers. The printing plate contains oleophilic and hydrophilic areas. The oleophilic areas are arranged according to the desired image which is to be printed onto media such as paper. The oleophilic areas attract the oil-based ink. Nonprint areas on the printing plate attract the water-based dampening fluid and repel the ink.

In order to achieve satisfactory printing, a proper balance must be achieved between the amount of dampening fluid applied to the plate versus the amount of ink that is applied. If too much dampening fluid is applied, then the print areas look faded, as the dampening fluid begins to be applied to the oleophilic areas. If too little dampening fluid is applied, then the ink appears in nonink areas. Much effort has gone into the systems that apply dampening fluid to a plate, in order to achieve this balance.

One type of inking system that is used is referred to as waterless printing by the printing industry. In waterless printing, dampening fluid is not used. Instead, only special inks are applied to the plate on the plate cylinder. The nonprint areas of the plate are coated with a silicone rubber film, which will not attract the ink under normal operating conditions. In order to maintain the ink away from the nonprint areas of the plate, the ink must be maintained within a certain temperature range. For example, some inks must be maintained within just a few degrees of 80 degrees Fahrenheit. If the ink becomes too cool or too warm, then its viscosity changes and the proper application of ink to the plate becomes increasingly difficult.

Printing presses are subjected to wide temperature ranges. For example, when a press is started first thing in the morning, it typically is below the desired ink temperature range for waterless printing. This is because the press has been sitting all night and has had a chance to cool off. As the press begins to operate, heat is generated by the friction between its rollers and also by the electric drive motors. The heat that is generated causes the temperature of the ink to increase beyond the desired temperature range for waterless printing. With the ink being above the desired temperature range, unsatisfactory printing results.

It is therefore desirable to provide a temperature controlled system for maintaining the temperature of the ink in a waterless printing system within the desired range.

SUMMARY OF THE INVENTION

It is the object of the present invention to provide a system for controlling the temperature of the ink being applied to a printing plate on a plate cylinder in a printing press.

The temperature control system of the present invention includes an ink roller, a circulation system and a refrigeration and heating system. The ink roller has a circulation path located therein. The circulation system is connected to the circulation path of the ink roller. The refrigeration and heating system includes a compressor, an expansion valve, a heat exchanger that is thermally coupled to a portion of the circulation system, a bypass conduit connected in parallel across the expansion valve and a valve located in the bypass conduit.

In one aspect of the present invention, a temperature sensor is located in the circulation system adjacent to the output of the heat exchanger. The valve that is located in the bypass conduit further comprises a solenoid valve that is coupled to the temperature sensor.

In another aspect of the present invention, another temperature sensor is located adjacent to the ink roller so as to sense the temperature of ink on the ink roller. The temperature sensor is connected to a cutoff valve that is located in that portion of the circulation system that provides circulation to the ink roller. In this manner, a single refrigeration and heating system can be used for plural ink rollers. Each ink roller that has fluid circulating therethrough has its own temperature sensor and cutoff valve. The temperature of the individual ink rollers can be controlled using the cutoff valve to regulate the amount of fluid flowing therethrough.

The method of the present invention controls the temperature of ink in a printing press. A first fluid is circulated through an ink roller on the press. The first fluid is also circulated through a heat exchanger. A second fluid is circulated through the heat exchanger and also circulated through a compressor and an expansion valve. At least some of the second fluid is bypassed around the expansion valve and directly to the heat exchanger from the compressor.

DESCRIPTION OF THE PREFERRED EMBODIMENT

Figure 1:
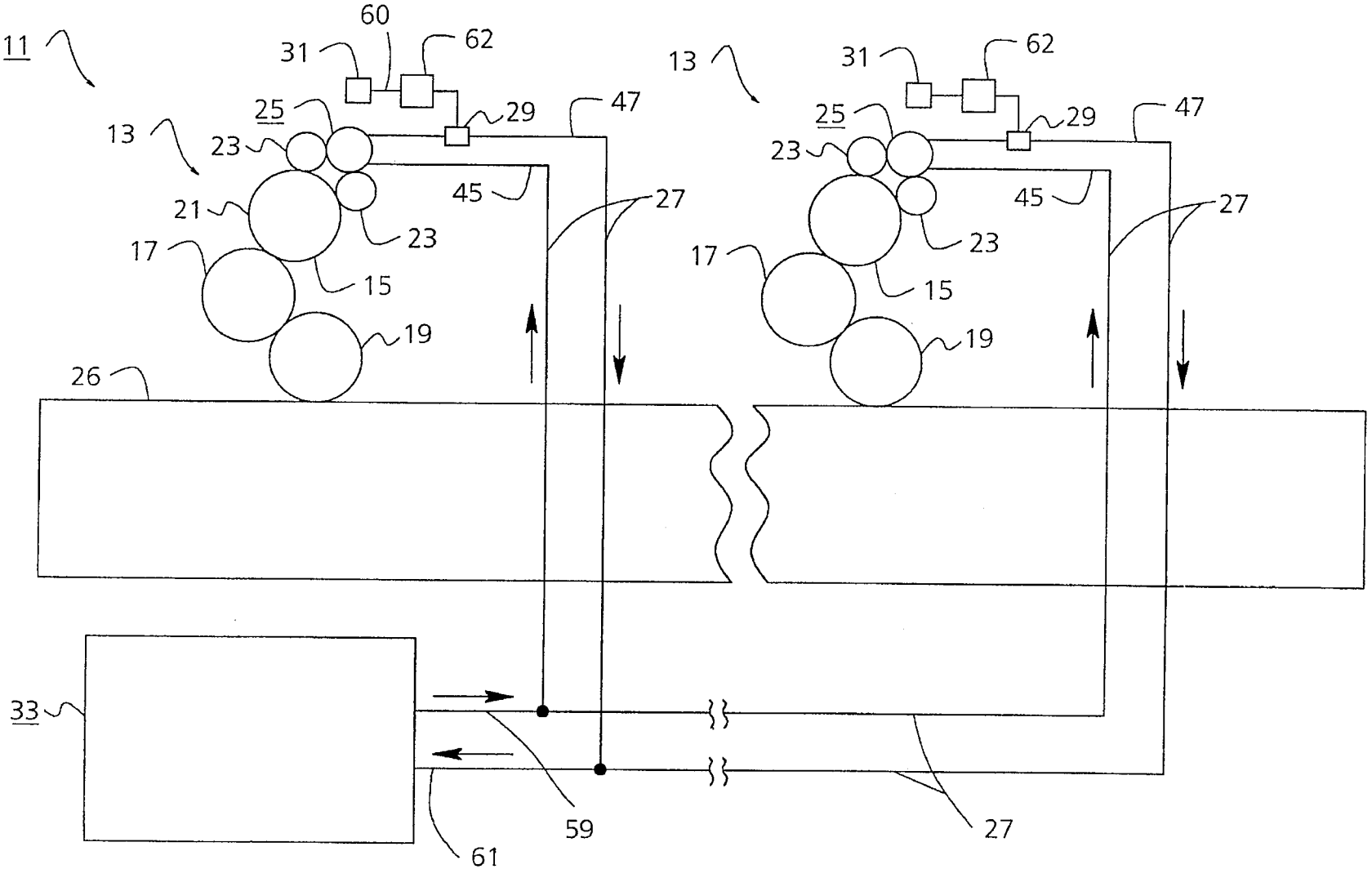
FIG. 1 is a schematic diagram of a plural towered printing press shown with the temperature controlled system of the present invention, in accordance with a preferred embodiment.

In FIG. 1, there is shown a schematic diagram of an offset lithographic printing press 11. The press has plural towers 13, with each tower printing one color. Each tower 13 has a plate cylinder 15, a blanket cylinder 17 and an impression cylinder 19. A respective printing plate 21 is located around the outside diameter of each plate cylinder 15. Ink form rollers 23 are provided to apply ink to the surface of the printing plate 21. In the preferred embodiment, the printing plate and ink are of the waterless printing type, wherein dampening fluid need not be applied to the printing plate.

Also provided is an ink vibrator roller 25 in rolling contact with the ink form rollers 23. There may be additional ink form rollers in contact with the printing plate, in which case an additional ink vibrator roller or rollers is provided. The inking system also includes other components (not shown) such as an ink pan for holding the ink and rollers for bringing the ink from the ink reservoir to the ink vibrator roller.

The rollers and cylinders are all rotatably mounted to the press by way of side frames or walls. The side frames are mounted to the base portion 26 of the press. Motors and gearing for rotating the rollers and cylinders are also provided.

The ink receptive areas of the printing plate (the print areas) receive ink from the ink form rollers, while the nonink areas (the nonprint areas) reject the ink. As the rollers and cylinders rotate, the ink image is transferred from the printing plate onto the surface of the blanket cylinder 17. The ink image is then transferred to paper passing between the nip formed between the blanket cylinder 17 and the impression cylinder 19.

The temperature control system of the present invention includes the ink vibrator rollers 25, a circulation system 27, control valves 29 in the circulation system, sensors 31 and a refrigeration and heating system 33. The circulation system 27 is a closed system of conduits that circulates a fluid such as water through the ink vibrator rollers 25 and through a heat exchanger in the refrigeration and heating system 33. The refrigeration and heating system 33 provides either a heat source (for heating) or a heat sink (for cooling) for the circulating fluid so as to provide for the temperature regulation of the fluid. Each sensor 31 determines the temperature of the ink on an ink vibrator roller 25, and if the temperature is outside of a specified range, then a controller that is connected to the sensor operates the respective control valve 29 to allow fluid to circulate through the respective ink vibrator roller. The circulating fluid thus maintains the ink in the desired temperature range.

A single refrigeration and heating system 33 is used for all of the towers on the press 11. The amount of heating or cooling for the individual ink vibrator rollers 25 and towers 13 is controlled by the control valves 29 that regulate the amount of fluid circulating in each roller 25.

Figure 3:
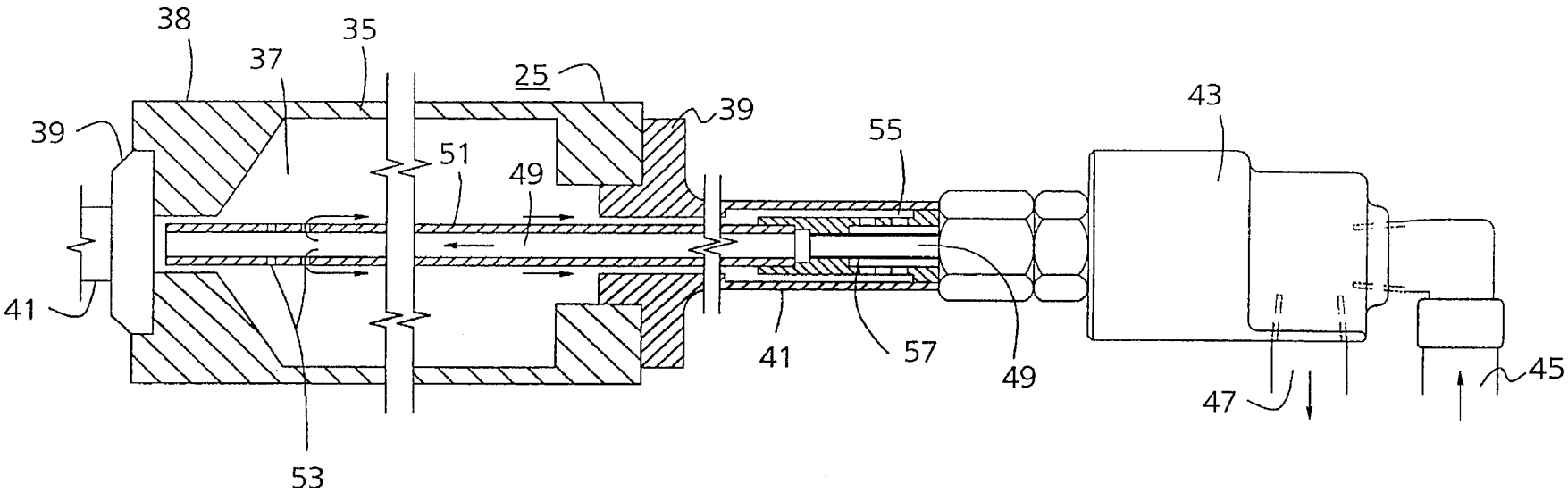
FIG. 3 is a longitudinal cross-sectional view of one of the ink vibrator rollers.

Referring now to FIG. 3, the ink vibrator rollers 25 will be described. The ink vibrator roller 25 on one tower is substantially similar to the other ink vibrator rollers on the other towers of the press. Each ink vibrator roller 25 has a cylindrical shell 35 that has an interior cavity 37. The outside diameter of the shell 35 has an outer surface 38 for receiving ink. This surface may be provided by a coating of nylon overlaying the metal shell. Alternatively, the shell may be made out of copper, with the outer surface 38 being polished. The ink is applied directly to the copper surface. The roller has end members 39, which close and seal off the interior cavity 37. The end members 39 have shafts 41 extending therefrom, which shafts are received by the side frames of the press. The side frames support the roller and allow its rotation relative to the press.

Connected to one end of the roller 25 is a rotating union 43. The union has an inflow conduit 45 and an outflow conduit 47 connected thereto. The union 43, which is conventional and commercially available, allows the roller to rotate, while the inflow and outflow conduits remain stationary. The roller has two channels located therein. The inflow channel 49, which communicates with the inflow conduit 45, extends along the longitudinal axis through an axial tube 51. The end portions of the tube have openings 53 therein to allow the circulating fluid to exit the tube and flow to the interior cavity 37. Heat is transferred between the circulating fluid in the interior cavity and the ink through the shell 35. The fluid exits the interior cavity by way of an outflow channel 55, which is formed by an annulus around the inflow channel 49. A thin walled tube 57 separates one portion of the inflow channel 49 from the outflow channel 55. The fluid exits the roller through the outflow conduit 47.

The inflow channel 49, the interior cavity 37 and the outflow channel 55 form a circulation path through the roller, where water enters and exits the roller from the same end.

As shown in FIG. 1, the circulation system 27 includes conduits extending from the refrigeration and heating system 33 to each of the ink vibrator rollers 25. Thus, the inflow conduit 45 of a particular ink vibrator roller is connected to an outflow conduit 59 of the refrigeration and heating system 33. In addition, the outflow conduit 47 of a particular ink vibrator roller 25 is connected to an inflow conduit 61 of the refrigeration and heating system. The conduits 45, 47 and the circulation paths through the ink vibrator rollers 25 form individual branches leading off of the main trunk conduits 59, 61.

There is a respective control valve 29 for each roller which has fluid circulating through it. The respective control valve 29 can be located in either the inflow conduit 45 or the outflow conduit 47 as shown in FIG. 1. The control valve 29 is an electrical operated valve. Each sensor 31 is connected, with electrical wires 60, to a respective controller 62 which in turn is connected to the respective control valve 29. In the preferred embodiment, each sensor 31 is an infrared sensor located close to the outer surface of the ink vibrator roller, so as to sense the temperature of the ink on the ink vibrator roller. For each ink vibrator roller 25 having fluid circulating therethrough, there is a sensor 31 for sensing the temperature of the ink. Each controller 62 actuates the respective control valve 29, causing the valve to open and close. Each controller 62 allows two temperatures, a high temperature and a low temperature, to be selected. For example, an ink temperature window of 78–82 degrees Fahrenheit could be programmed into one of the controllers 62. If the respective sensor 31 detected an ink temperature that was either above or below this range, then the controller 62 would open the control valve 29 so as to allow fluid to circulate through the respective roller 25. When the sensor 31 senses that the ink temperature on the roller 25 is within the selected range of 78–82 degrees Fahrenheit, then the controller 62 closes the valve 29. The sensors 31, valves 29 and controllers 62 are all conventional and commercially available components.

Figure 2:
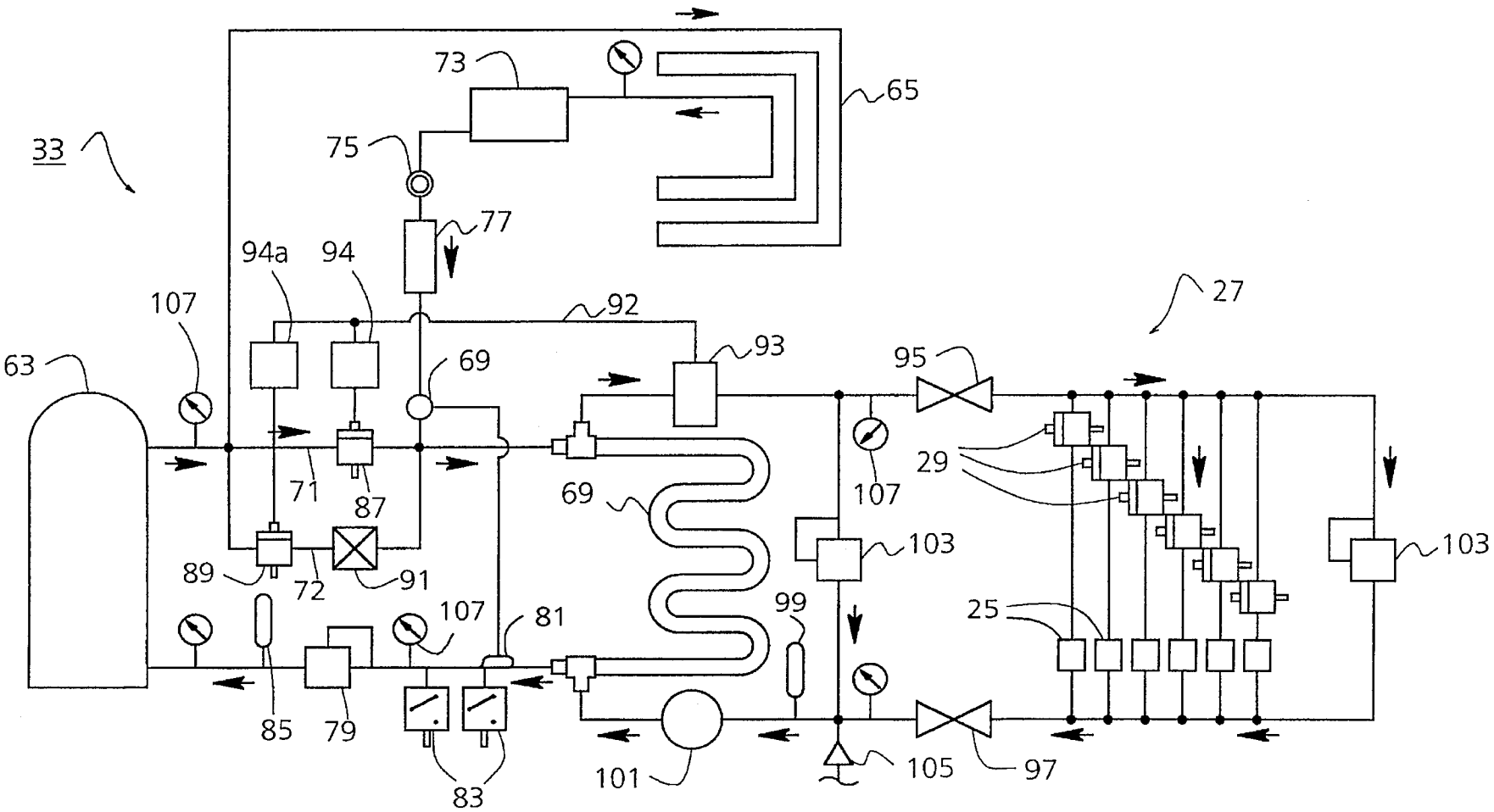
FIG. 2 is a schematic diagram of the refrigeration and heating system and the circulation system.

The refrigeration and heating system 33 heats or cools the fluid circulating through the individual ink vibrator rollers 25. Referring to FIG. 2, the refrigeration and heating system 33 will now be described. The system includes a compressor 63, a condenser 65, an expansion valve 67, and an evaporator 69 (which is a heat exchanger). All of these components are conventional and commercially available. In addition, the refrigeration and heating system 33 includes one or more bypass conduits 71, 72. A conventional refrigerant fluid such as a fluorocarbon (for example freon) is used in the refrigeration and heating system 33.

The refrigerant fluid flows in a circuit of conduits as follows: leaving the compressor 63 the fluid flows through the condenser 65, into a receiver 73, through a sightglass 75, through a filter/drier 77, through the expansion valve 67, through the evaporator 69, through a regulator 79 and back to the compressor 63. The expansion valve 67 is of the thermostatic type, having a superheat sensor 81 located at the outlet of the evaporator 69. The superheat sensor 81 acts as a regulator, controlling to a certain extent, the flow of the refrigerant through the expansion valve based upon the sensed superheat of the refrigerant exiting the evaporator. The superheat sensor 81 boosts the efficiency of the evaporator 69 by ensuring that the fluid exiting the evaporator is all gas and no liquid. If the refrigerant exiting the evaporator is too cold, as sensed by the superheat sensor 81, then the sensor causes the expansion valve 67 to close to either reduce or shut off the flow of refrigerant through the expansion valve.

Pressure switches 83 are connected to the refrigerant circuit, between the superheat sensor 81 and the regulator 79. An accumulator 85 is also connected to the refrigerant circuit, at a location downstream from the regulator and upstream from the inlet of the compressor 63.

The bypass conduits 71, 72 bypass that portion of the refrigerant circuit from the condenser 65 to the expansion valve. Thus, the hot refrigerant fluid from the compressor 63 flows through the bypass conduits directly into the evaporator 69, without being condensed and expanded (and therefore cooled). One of the bypass conduits 71 has an electrical operated valve 87 to control the flow of refrigerant through the conduit. When the solenoid valve 87 is open, all of the refrigerant exiting the compressor 63 bypasses the expansion valve and flows directly into the evaporator 69. The other bypass conduit 72 has an electrically operated valve 89 and restrictor valve 91. The restrictor valve 91 allows a limited amount of the refrigerant to bypass the expansion valve 67. In the preferred embodiment, the restrictor valve 91 is an adjustable needle valve. The adjustment of the needle valve is typically set once, either at the factory or upon installation of the temperature control system into the press.

The evaporator 69 is of the water jacketed type. The fluid circulating in the circulation system 27 and through the ink vibrator rollers 25 exchanges heat with the refrigerant in the evaporator 69. In the preferred embodiment, the circulating fluid is purified and filtered water.

As the water exits the evaporator 69, it passes a thermocouple sensor 93, flows through a first stop valve 95, through one of the control valves 29 and through the respective ink vibrator roller 25, through a second stop valve 97, past an accumulator 99, into a pump 101 and back into the evaporator 69. Pressure relief valves 103 are provided across the evaporator 69 and across the array of branches provided by control valves 29 and ink receptive rollers 25. The pump 101 circulates the water through the circulation system. Make up water is added to the circulation system 27 through a one-way check valve 105.

The thermocouple sensor 93, which senses the temperature of the water exiting the evaporator 69, is connected to both of the bypass solenoid valves 87, 89 by electrical wires 92 and through respective controllers 94, **94*a*. Each valve 87, 89 has a controller 94, 94*a*. Each controller 94, 94*a* has a preselected temperature. When the temperature of the water exiting the evaporator reaches a respective preselected temperature, as determined by the sensor 93, then the respective controller 94, 94*a* actuates the respective valve 87, 89. The sensor 93, the controllers 94, 94*a* and the valves 87, 89** are conventional and commercially available.

Pressure gauges 107 may be provided at various locations in the refrigerant fluid circuit and in the water circulation system 27 to monitor the circuits.

The electrical components of the temperature control system are powered by either 110 or 220 volt ac electrical power.

The operation of the present invention will now be described. In the morning, the press 11 and the temperature control system are both turned on. This turns on the pump 101, wherein water is circulated through the circulation system 27, and also turns on the compressor 63. Both the pump 101 and the compressor 63 operate continuously. The compressor 63 begins compressing the refrigerant fluid. The valves 94, **94*a* are initially closed so that the refrigerant fluid circulates through the condenser 65, the expansion valve 67 and the evaporator 69**.

As the press components begin to rotate, the ink is typically cooler than desired. Therefore, the temperature control system provides heat to the ink. The sensor 93 senses the temperature of the water exiting the evaporator. The controllers 94, **94*a* detect that the water is too cold (because the sensed temperature is below the preselected temperatures in the controllers) and open both valves 87, 89. This causes the hot fluid from the compressor to flow through bypass conduits 71, 72, bypassing the condenser 65 and the expansion valve 67. When bypass conduit 71 is open, substantially all of the fluid from the compressor bypasses the expansion valve thereby providing for fast heating of the water in the circulation system. The hot fluid flows into the evaporator 69**, where it heats the water in the circulation system.

Individual rollers 25 with ink that is too cold are warmed because the sensors 31 and their controllers 62 open the respective valves 29, thereby allowing the warm water to circulate through the rollers 25. When the ink on a roller 25 is brought within the desired temperature range, as sensed by the sensor 31, then the controller 62 closes the respective valve 29, thereby closing off circulation through that roller. This prevents the ink from becoming too warm. The water circulates through the other rollers or open branches. The present invention allows the individual towers to be controlled independently of each other. This is particularly useful, as the different colored inks used in the towers may have different acceptable temperature ranges.

After the temperature control system has been on for several minutes, the ink in all of the towers should be within the acceptable temperature ranges. Therefore, printing operations can begin. The ink, which is maintained at the correct temperature, is applied to the plate 21 on the plate cylinder 15. When the ink on a particular roller 25 begins to cool off, as sensed by the sensor 31, and due to the lack of fluid circulating through the roller, then the controller 62 opens the valve 29 to allow more fluid to circulate through the roller. This process of automatically opening and closing the valve 29 to regulate the amount of water circulating through the roller is repeated as the temperature of the ink fluctuates within and without the acceptable temperature range.

As the press continues to operate, heat is built up on the rollers. Thus, the water exiting the evaporator will exceed a first preselected temperature. When the temperature of the water exiting the evaporator 61 is warmed to the first preselected temperature, then the controller 94 closes off the valve 87 in the main bypass conduit 71. Some of the refrigerant exiting the compressor continues flowing through the other bypass conduit 72, while the remainder begins to flow through the condenser 65 and the expansion valve 67. The restrictor valve 91 limits the amount of fluid that can bypass the expansion valve. This causes mixing in the evaporator of refrigerant fluid that is both cooled, by its passage through the condenser and the expansion valve, and hot, by its bypassing the condenser and the expansion valve. In this manner, the desired temperature in the heat exchange evaporator 69 can be achieved.

If the water exiting the evaporator is warmed to a second preselected temperature, indicating that the press is continuing to warm, then the controller **94*a* will close the valve 89 in the bypass conduit 72. Thus, all of the refrigerant fluid will be routed through the condenser and the expansion valve to provide refrigeration. When the water cools below the second preselected temperature, then the valve 89** automatically opens to bypass some hot fluid to the evaporator. As the day progresses, the press will heat up, requiring more and more cooling and less heating. Typically, several hours into a press run, only refrigeration will be needed.

Although the present invention has been described as providing temperature controlled water circulating through ink receptive rollers, other types of ink rollers could be utilized for circulation. It is generally preferred to provide circulation through the rollers that are closest to the plate cylinder so as to achieve better temperature control.

If a tower has two ink vibrator rollers, only one sensor 31 is utilized, and this is on the downstream ink vibrator roller. Each tower has its control valve 29.

The foregoing disclosure and the showings made in the drawings are merely illustrative of the principles of this invention and are not to be interpreted in a limiting sense.

We claim:

1. A system for controlling the temperature of ink in a printing press, comprising:

a) an ink roller having a circulation path therein, said ink roller being part of an ink path leading to a printing cylinder of said printing press;

b) a circulation system connected to said circulation path of said ink roller, said circulation system having a valve to regulate the amount of fluid flowing into said ink roller;

c) a refrigeration and heating system comprising a compressor, a condenser, an expansion valve, and a heat exchanger, said compressor having a compressor input and a compressor output, said condenser having a condenser input and a condenser output, said heat exchanger having a heat exchanger input and a heat exchanger output, said condenser input being connected with said compressor output, said expansion valve being connected with said condenser output and also with said heat exchanger input, said heat exchanger output being connected to said compressor input, said heat exchanger being thermally coupled to a portion of said circulation system, said refrigeration and heating system further comprising a bypass conduit connected to said compressor output and to said heat exchanger input so as to bypass said condenser and said expansion valve, said bypass conduit having a bypass valve for opening and closing said bypass conduit so as to control the temperature of fluid flowing into the ink roller.

2. The system of claim 1 further comprising a second bypass conduit connected in parallel across said expansion valve, said second bypass conduit having a second valve and a restrictor located therein.

3. The system of claim 1 further comprising a temperature sensor located in the circulation system adjacent to an output of said heat exchanger, said valve that is located in said bypass conduit further comprising a solenoid valve that is coupled to said temperature sensor.

4. The system of claim 1 further comprising a temperature sensor located adjacent to said ink roller so as to sense the temperature of ink on said ink roller, said temperature sensor being connected to a cutoff valve located in that portion of said circulation system providing circulation to said ink roller.

5. The system of claim 4 wherein said temperature sensor comprises an infrared sensor.

6. The system of claim 1 further comprising:

a) a first temperature sensor located in the circulation system adjacent to an output of said heat exchanger, said bypass valve that is located in said bypass conduit further comprising a solenoid valve that is coupled to said first temperature sensor;

b) a second temperature sensor located adjacent to said ink roller so as to sense the temperature of ink on said ink roller, said second temperature sensor being connected to a cutoff valve located in that portion of said circulation system providing circulation to said ink roller.

7. The system of claim 1, wherein said ink roller has first and second ends and an interior cavity that extends between said first and second ends, said interior cavity communicating with a first channel that is located at the first end, said roller having a conduit that is located in said interior cavity and that extends between said first and second ends, said conduit communicating with a second channel that is located at said first end, said conduit communicating with said interior cavity at said second end.

* * * * *